US006006045A

United States Patent [19]

Miyawaki

[11] Patent Number: 6,006,045

[45] Date of Patent: Dec. 21, 1999

[54] IMAGE FORMING APPARATUS SUPERVISING SYSTEM

[75] Inventor: Shohzou Miyawaki, Saitama, Japan

[73] Assignee: Ricoh Company, Ltd., Tokyo, Japan

[21] Appl. No.: 09/048,086

[22] Filed: Mar. 26, 1998

[30] Foreign Application Priority Data

Mar. 26, 1997 [JP] Japan ..... 9-073306

[51] Int. Cl.[6] ..... G03G 15/00

[52] U.S. Cl. ..... 399/8; 399/79

[58] Field of Search ..... 399/8, 11, 79, 399/80

[56] References Cited

U.S. PATENT DOCUMENTS

| | | | |
|---|---|---|---|
| 5,016,059 | 5/1991 | Smeiman | 399/80 |
| 5,066,977 | 11/1991 | Yoshizuka | 399/80 |
| 5,077,582 | 12/1991 | Kravette et al. | 399/8 |
| 5,142,324 | 8/1992 | Ito | 399/79 |
| 5,206,891 | 4/1993 | Kishimoto | 377/55 |
| 5,715,496 | 2/1998 | Sawada et al. | 399/8 |
| 5,752,128 | 5/1998 | Yamashita | 399/80 |

FOREIGN PATENT DOCUMENTS 5-324971 12/1993 Japan .

*Primary Examiner*—Robert Beatty
*Attorney, Agent, or Firm*—Oblon, Spivak, McClelland, Maier & Neustadt, P.C.

[57] ABSTRACT

An image forming apparatus control system including at least one copier or similar image forming apparatus and a central control unit connected by a data communication unit and a communication line is disclosed. The image forming apparatus selectively inhibits or permits its image forming operation on receiving image formation control data representative of inhibition or permission, respectively, from the central control unit. An inhibiting device is included in the apparatus for inhibiting, if the apparatus is performing a current image forming operation at the time of receipt of the image formation control data representative of inhibition, the next image forming operation after the current operation has completed.

11 Claims, 10 Drawing Sheets

IMAGE FORMING APPARATUS SUPERVISING SYSTEM

BACKGROUND OF THE INVENTION

1. Field of the Invention

The present invention relates to an image forming apparatus supervising system in which at least one copier or similar image forming apparatus and a central control system are interconnected by a data communication unit and a communication line.

2. Discussion of the Background

Typically, in an image forming apparatus supervising system, image forming apparatuses located at many and unspecified users' stations are connectable to a central control unit or host situated at a sales station or a service station by a data communication unit and a public network or similar communication network. The image forming apparatuses may be copiers subjected to remote diagnosis. The system implements efficient and immediate services by executing the following three kinds of controls (1)–(3):

(1) communication control from the central control unit to the image forming apparatuses;

(2) communication control from the image forming apparatuses to the central control unit or to the data communication unit; and (3) individual control of the data control unit.

As for the term of use of the image forming apparatus, a distributor or a service company in charge of the apparatus often makes a contract with the user of the apparatus in terms of the number of sheets used to form images (block billing). In such a case, when the cumulative number of sheets used by the user reaches a billing number agreed upon at the time of contract, the central control unit situated at the distributor or the service company inhibits the apparatus from being operated any further, as needed, and urges the user to renew the contract. To inhibit or permit the further operation of the apparatus, the central control unit sends image formation control data representative of inhibition or permission to the apparatus. In response, the apparatus inhibits or allows the user to operate it.

However, the conventional system has the following problem left unsolved. Assume that the cumulative number of sheets used with the image forming apparatus reaches the billing number, and that the apparatus receives the control data representative of inhibition from the central control unit. Then, even when the apparatus is performing an image forming operation, it is forced to stop it and prevented from outputting a desired number of images.

SUMMARY OF THE INVENTION

It is therefore an object of the present invention to provide an image forming apparatus supervising system allowing an image forming apparatus to output a desired number of images even when the cumulative number of sheets used with the apparatus reaches a billing number during image formation.

An image forming apparatus control system including at least one copier or similar image forming apparatus and a central control unit connected by a data communication unit and a communication line is disclosed. The image forming apparatus selectively inhibits or permits its image forming operation on receiving image formation control data representative of inhibition or permission, respectively, from the central control unit. An inhibiting device is included in the apparatus for inhibiting, if the apparatus is performing an image forming operation at the time of receipt of the image formation control data representative of inhibition, the image forming operation after it has completed.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
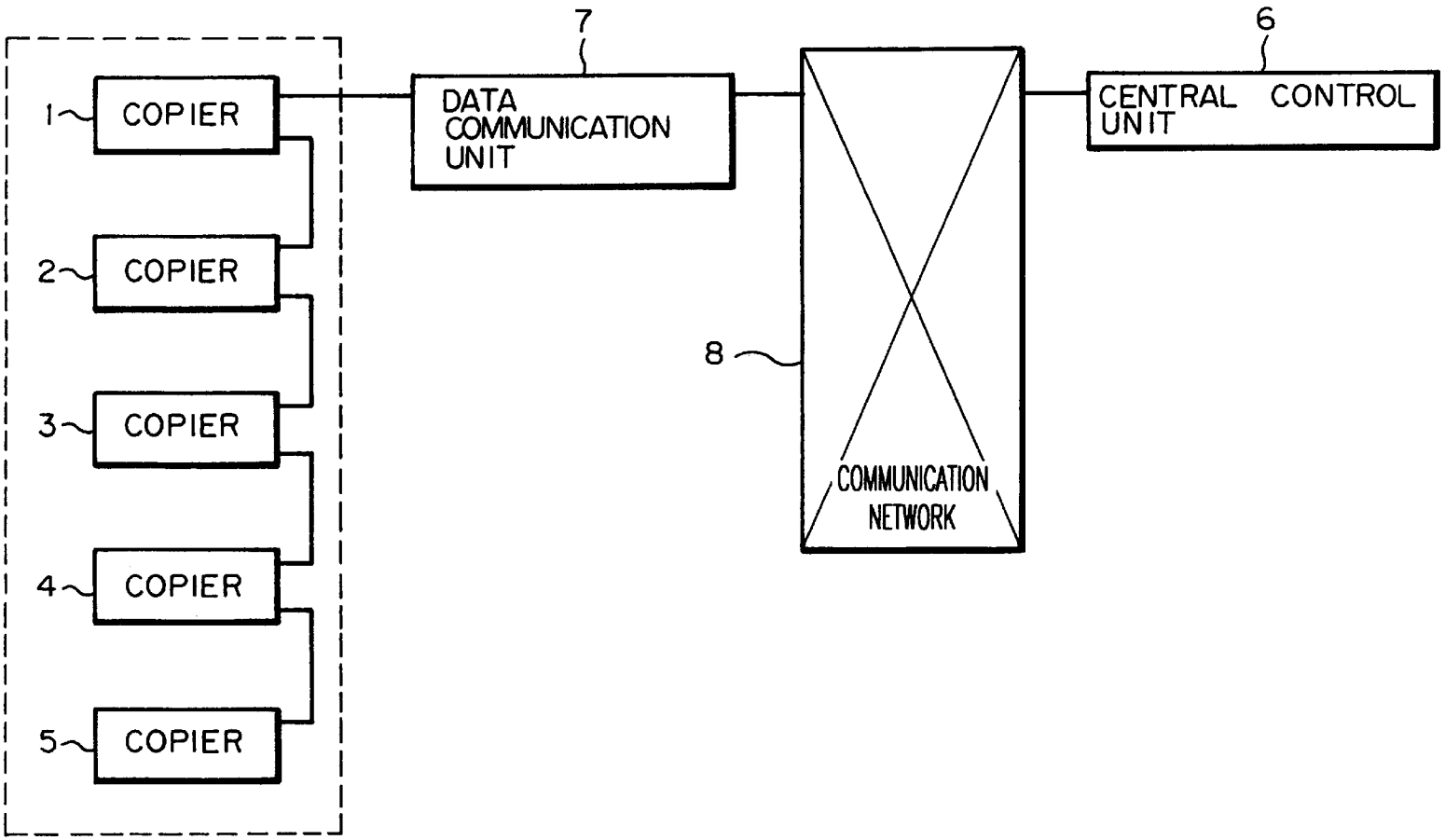
FIG. 1 is a block diagram schematically showing an image forming apparatus supervising system embodying the present invention.

Referring to FIG. 1 of the drawings, an image forming apparatus supervising system embodying the present invention is shown. As shown, the system includes a plurality of (five in the embodiment) image forming apparatuses 1, 2, 3, 4 and 5 and a central control unit 6. The image forming apparatuses 1–5 are implemented as copiers by way of example and subjected to remote diagnosis. The central control unit 6 is connected to the copiers 1–5 by a data communication unit 7 and a communication network 8 so as to supervise the copiers 1–5 collectively.

The data communication unit 7 transfers command signals (copy control data) received from the central control unit 6 to the copiers 1–5 and transfers various information (copy control data) received from the copiers 1–5 to the control unit 6. The data communication unit 7 is powered throughout the day. This allows the control unit 6 and copiers 1–5 to communicate with each other even at night time when the copiers 1–5 are usually powered-down. The data communication unit 7 and copiers 1–5 are held in multidrop connection by a serial communication interface RS-485. Specifically, the data communication unit 7 communicates with the copiers 1–5 by polling and selecting.

Figure 2:
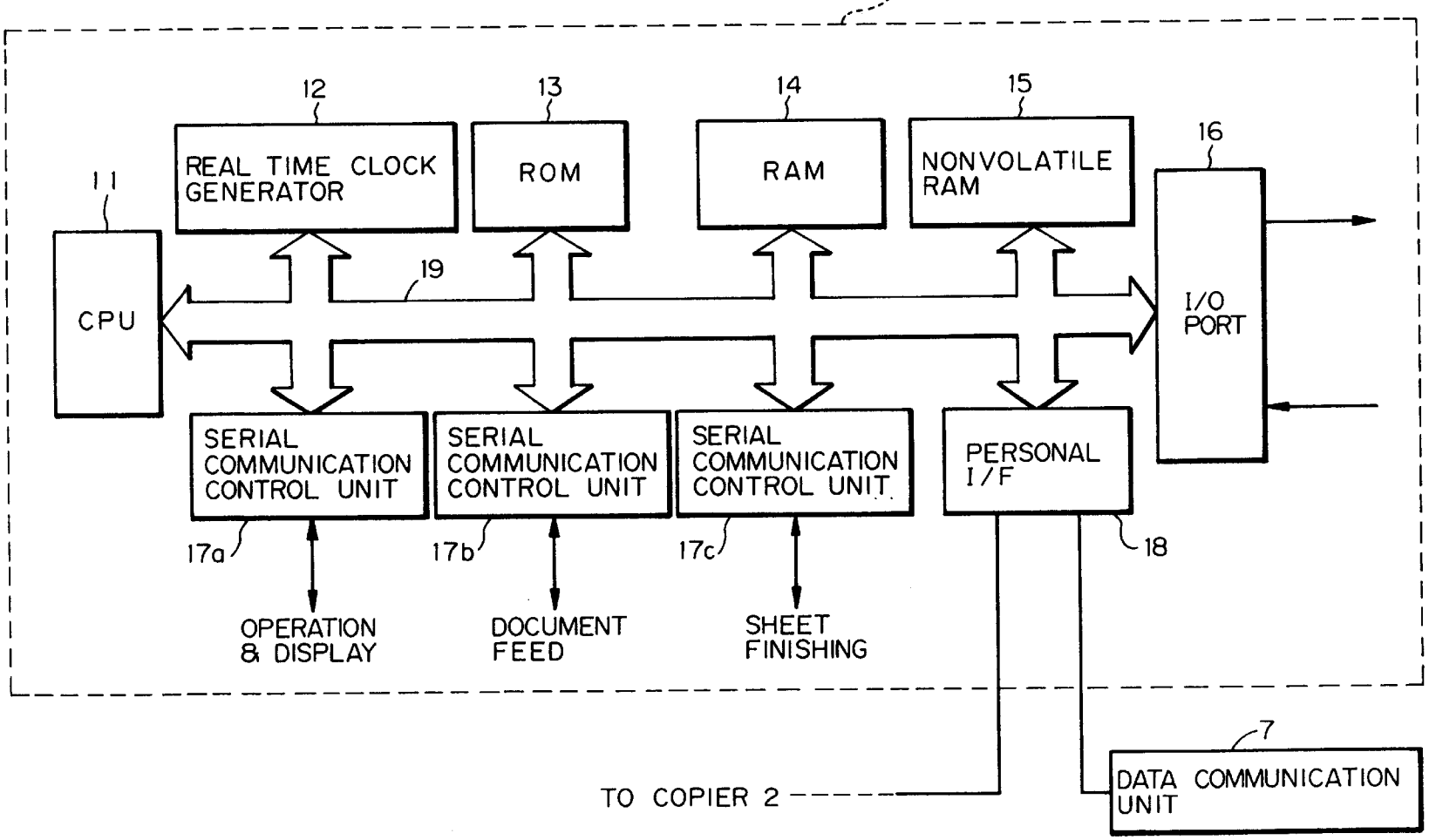
FIG. 2 is a block diagram schematically showing a specific configuration of a control section included in each of copiers shown in FIG. 1.

FIG. 2 shows a specific configuration of a control section included in the copier 1. The copiers 2–5 are identical in configuration with the copier 1 and will not be described specifically in order to avoid redundancy. As shown, the control section includes a PPC (Plain Paper Copier) controller made up of a CPU (Central Processing Unit) 11, a real time clock generator 12, a ROM (Read Only Memory) 13, a RAM (Random Access Memory) 14, a nonvolatile RAM 15, an I/O (Input/Output) port 16, and serial communication control units 17*a,* 17*b* and 17*c*. The control section further includes a personal interface (I/F) 18 and a system bus 19.

The CPU 11 controls the entire control section in accordance with a control program stored in the ROM 13. The real time clock generator 12 generates time information and allows the CPU 11 to see the current time. The ROM 13 stores various kinds of fixed data in addition to the control program. The RAM 14 plays the role of, e.g., a work memory to be used by the CPU 11 for data processing. The nonvolatile RAM 15 is backed-up by a battery and stores, e.g., the contents of mode commands input on an operation and display panel which will be described. The I/O port 16 is connected to motors, solenoids, clutches and other output loads, sensors and switches included in the copier 1.

The serial communication units 17*a*–17*c* respectively interchange signals with the operation and display panel, a document feed section, not shown, and a sheet finishing section, not shown.

The personal I/F 18 governs communication between the copier 1 and the data communication unit 7 in order to reduce the load on the CPU 11. Of course, the function of the personal I/F 18 may be assigned to the CPU 11 if the CPU 11 has a sufficient processing ability. The personal I/F 18 has the following major functions (1)–(4):

(1) monitoring polling and selecting from the data communication unit 7;

(2) affirmation/negation response processing;

(3) determining whether or not data interchanged between the copier 1 and the data communication unit 7 are warrantable, parity checking, and reset request processing when an error occurs; and (4) header processing for data interchanged between the copier 1 and the data communication unit 7.

The system bus 19 is made up of an address bus, a control bus and a data bus and connect the CPU 11, real time clock generator 12, ROM 13, RAM 14, RAM 15, I/O port 16, serial communication control units 17*a*–17*c,* and personal I/F 18.

Figure 3:
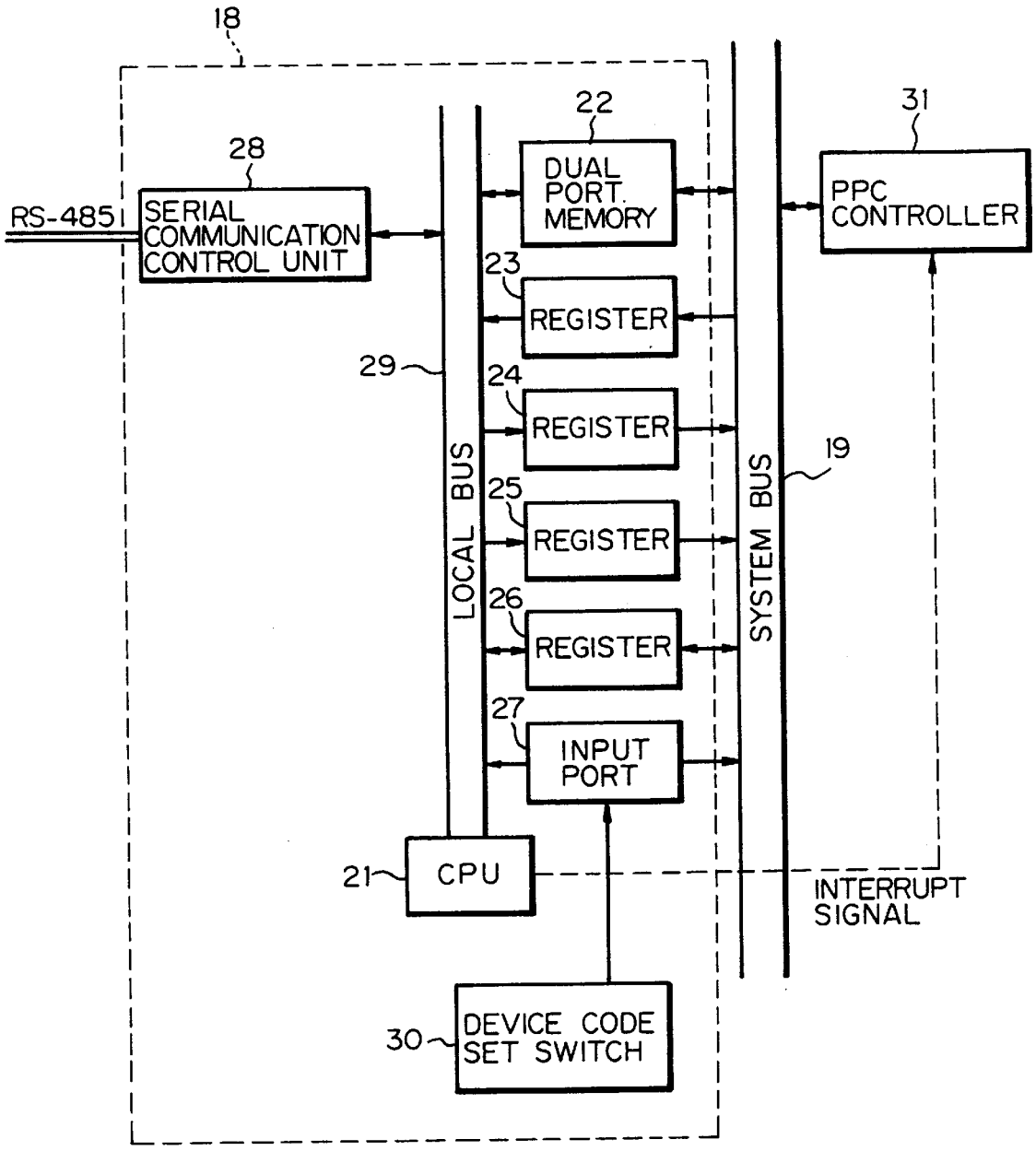
FIG. 3 is a block diagram schematically showing a personal interface also included in the copier.

A specific configuration of the personal I/F 18 controlled by the CPU 21 will be described with reference to FIG. 3. As shown, the personal I/F 18 has a CPU 21, a dual port memory 22, registers 23–26, an input port 27, a serial communication control unit 28, a local bus 29, a one-chip microcomputer made up of a ROM and a RAM, not shown, and a device code setting switch 30. The dual port memory 22 allows both of the CPU 11 of FIG. 2 and the CPU 21 to read and write data therein. The dual port memory 22 is a data memory used for the personal I/F 18 and PPC controller 31 to interchange data.

The PPC controller 31 is constituted by the CPU 11, real time clock generator 12, ROM 13, RAM 14, nonvolatile RAM 15, I/O port 16, and serial communication control units 17*a*–17*c*.

The registers 23–26 are used to control the interchange of the above text data, although not shown or described specifically. The device code setting switch 30 is used to set a device code particular to the copier 1 and which should be identified at the time of polling and selecting from the data communication unit 7. The serial communication control unit 28 is connectable to the data communication unit 7 and/or the personal I/F of another copier.

Figure 4:
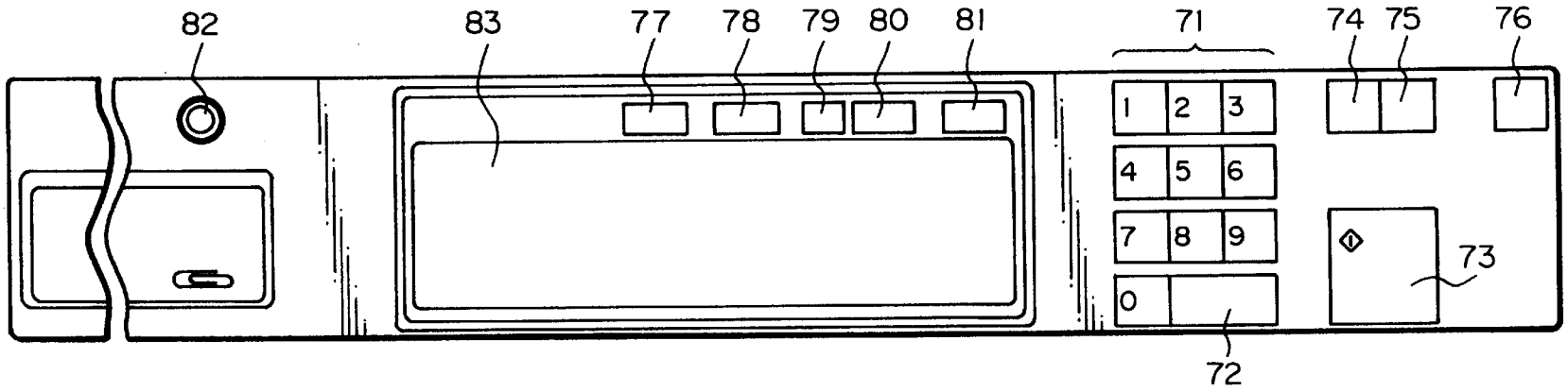
FIG. 4 shows a specific arrangement of an operation and display panel also included in the copier.

FIG. 4 shows a specific arrangement of the operation and and display panel included in each of the copiers 1–5. The operation and display panel, like the control section of the copier 1, includes a ROM storing a control program, a CPU for executing various kinds of control in accordance with the control program, a RAM for temporarily storing data, a serial communication control unit, and an I/O port, and interchanges data with the serial communication control unit 17*a* of the PPC controller 31, although not shown or described specifically. Arranged on the panel are numeral keys 71, a clear/stop key 72, a copy start (print) key 73, an enter key 74, an interrupt key 75, a mode clear/preheat key 76, a mode confirm key 77, a picture select key 78, a call key 79, a register key 80, a guidance key 81, a display contrast volume 82, and a character display 83.

The numeral keys 71 are used to input a desired number of copies. The clear/stop key 72 is used to clear the number of copies or to sop a copying operation under way. The copy start key 73 is used to start a copying operation. The enter key 74 is used to enter numerical values including a zoom magnification and a binding margin. The interrupt key 75 is used to copy a document or documents by an interrupt while a copying operation is under way. The mode clear/preheat key 76 is used to cancel all of set modes or to set a preheat mode for a power saving purpose. The mode confirm key 77 is used to see a list of copy modes selectively to appear on the character display 83.

The picture select key 78 is used to select a desired display format on the character display 83 in accordance with the user's or operator's degree of skill. The call key 79 is used to call a user program. The register key 80 is used to register the user program. The guidance key 81 is used to see, e.g., guidance messages on the character display 83. The display contrast volume 82 is used to adjust the contrast of the character display 83. The character display 83 is made up of an LCD (Liquid Crystal Display), fluorescent display tube or similar full-dot display device and a transparent sheet-like matrix touch panel having a number of touch sensors thereinside. For example, a single touch sensor is assigned to every 8×8 display pixel matrix.

Figure 5:
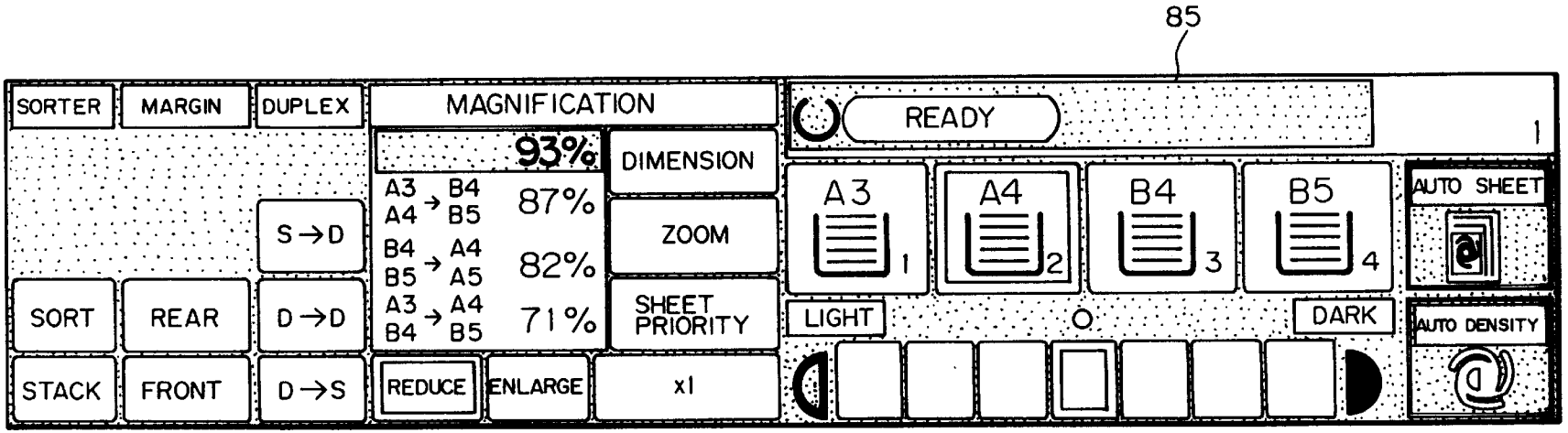
FIG. 5 shows a specific usual copy mode picture to appear on a character display included in the operation and display panel.

FIG. 5 shows a specific usual copy mode picture to appear on the character display 83 at the time of power-up. The operator may press, or touch, any one of the keys (display portions) included in the usual copy mode picture so as to select a desired sheet size (cassette), image density (copy density), magnification change ratio, duplex copy mode, sort mode or similar copy mode. The key touched by the operator is reversed in color. In the specific picture of FIG. 5, a magnification change ratio of 93%, an automatic sheet size (automatically matching with a document size), an automatic image density (automatically matching with a document density), and a single copy are shown. The picture additionally includes a message area 85 capable of displaying various kinds of messages, e.g., "Ready to copy.", "Copying.", "Stack sheets.", "Unable to copy because the billing number is reached.", and "The billing number will be reached soon.".

Figure 6:
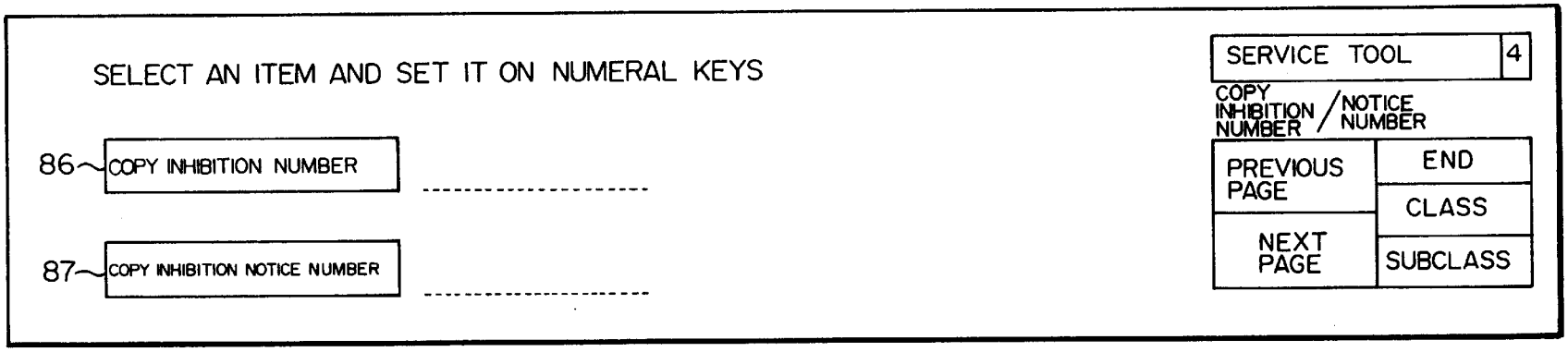
FIG. 6 shows a specific service program mode picture to appear on the character display of FIG. 5.

The usual copy mode picture shown in FIG. 5 is replaced with a specific service program mode picture shown in FIG. 6 when preselected keys on the operation and display panel are manipulated, e.g., when a preselected code number is input on the numeral keys 71. As shown, the service program mode includes a copy inhibition number (billing number) key 86 and a copy inhibition notice number key 87. When the copy inhibition key 86 is pressed, a copy inhibition number set mode is set up and allows a copy inhibition number, e.g., 2,000 copies to be set on the numeral keys 71.

When the copy inhibition notice number key 87 is pressed, a copy inhibition notice number is set up and allows a copy inhibition notice number for precaution to be input on the numeral keys 71.

Figure 7:
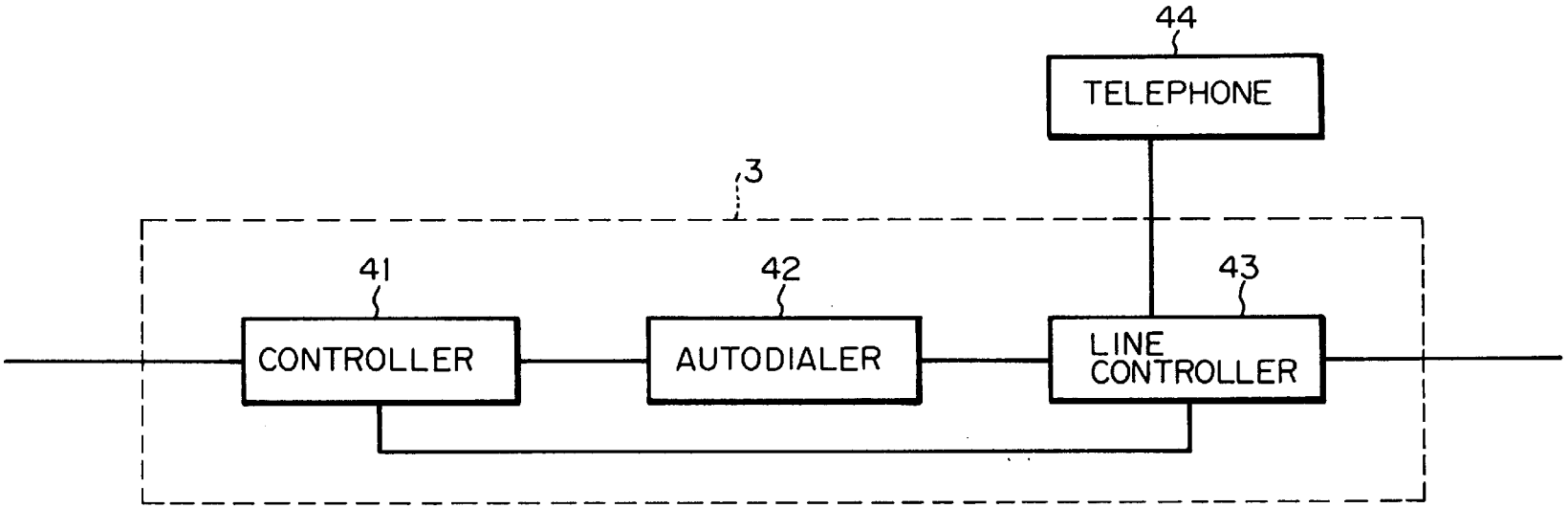
FIG. 7 is a block diagram schematically showing a specific configuration of a data communication unit included in the illustrative embodiment.

FIG. 7 shows a specific construction of the data communication unit 7 of FIG. 1. As shown, the data communication unit 7 includes a controller 41, an autodialer 42 and a line controller 43. The controller 41 controls the five copiers 1–5 and controls the receipt of commands from the central control unit 6 via the communication network 8. The autodialer 42 automatically dials the central control unit 6 in response to various kinds of reports received from the copiers 1–5. The line controller 43 controls the connection of the data communication unit 7 to the communication network 8 and controls the switching to a telephone set 44. The controller 41, like a conventional controller (e.g. controller of the copier 1 shown in FIG. 2), includes a ROM storing a control program, a CPU for executing various kinds of control in accordance with the control program, a RAM for temporarily storing data, a nonvolatile RAM backed up by a battery, a serial communication control unit, and an I/O port. The controller 41 additionally includes a real time clock generator (not shown).

The nonvolatile RAM of the controller 41 stores data sent from one of the central control unit 6 and copiers 1–5 to the other, device codes and identification (ID) codes for allowing one of the copiers 1–5 to be designated at a time, the telephone number of the central control unit 6, the number of repeat calls made when line connection has failed, the interval of repeat calls, and the dates and times of transmission of total counter values (total numbers of copies).

The general functions available with the supervising system are generally classified into the following three different functions (1)–(3):

(1) control over communication from the central control unit 6 to the copiers 1–5;

(2) control over communication from the copiers 1–5 to the central control unit 6 or to the data communication unit 7; and (3) individual control of the data communication unit 7.

The function (1) includes the following specific functions (a)–(c):

(a) reading and resetting the total number of copies of the individual copier, the cassette-by-cassette numbers of copies, size-by-size numbers of copies, the number of times of misfeed, size-by-size numbers of misfeeds, the numbers of times of misfeed each occurred at a particular sheet transport position, etc;

(b) setting and reading control voltage, current, resistance, timing and other adjustable values of each unit included in the individual copier; and (c) returning results of communication effected from the copiers 1–5 to the central communication unit 6 (function (2)).

The above control is executed by the data communication unit 7 in response to a command signal output from the central control unit 6 by a selecting procedure. The word "selecting" refers to the function of selecting one of the five copiers 1–5 at a time and communicating therewith.

Figure 8:
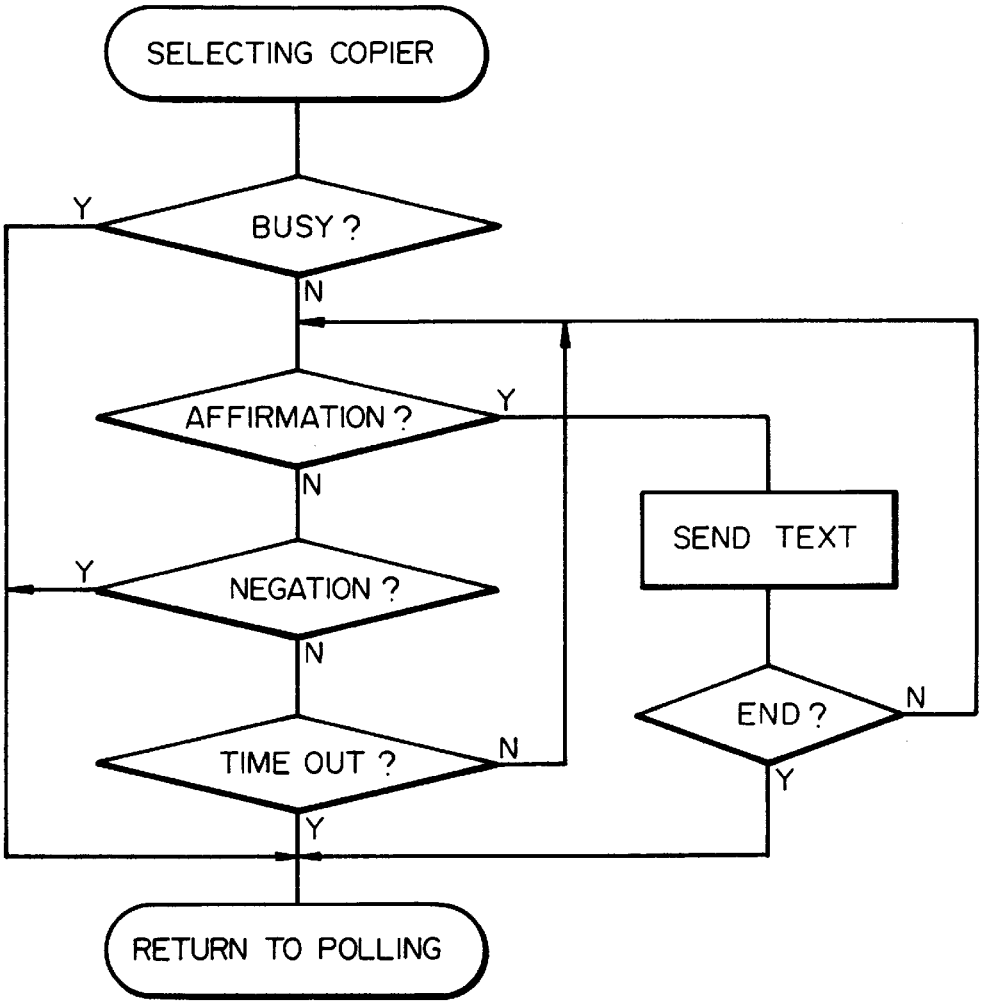
FIG. 8 is a flowchart demonstrating a specific selecting procedure to be executed by the data communication unit.

FIG. 8 is a flowchart demonstrating a specific selecting procedure particular to the data communication unit 7. A particular device code is assigned to each of the copiers 1–5. The data communication unit 7 sends a particular code (or combination of particular codes) representative of a preselected selecting function and a device code designating a particular one of the copiers 1–5 via the serial communication interface RS-485.

The copiers 1–5 each compare, based on the particular code representative of the selecting function, the device code following the particular code with its own device code, and knows that it is selected if they compare equal. If the copier designated has any data to send, it outputs a "busy" answer represented by a preselected code (or combination of preselected codes). In response, the data communication unit 7 interrupts the selecting operation and starts a polling operation which will be described later.

When the copier designated has no data to send, the copier determines whether or not it is capable of dealing with the selecting. If the copier is capable of dealing with the selecting, it outputs an affirmation answer represented by a particular code (or combination of particular codes) and then communicates with the data communication unit 7. If the copier is not capable of dealing with the selection, it outputs a negation answer represented by a particular code (or combination of particular codes) and then communicates with the data communication unit 7. Further when the copier designated cannot output either the affirmation answer or the negation answer due to, e.g., the power-down of the copier, the data communication unit 7 ends the selecting operation on the elapse of a preselected period of time.

The function (2) mentioned earlier includes the following specific functions (a)–(e):

(a) When an error practically disabling any one of the copiers 1–5 occurs in the copier, the copier sends information representative of the error to the central control unit 6 immediately via the data communication unit 7 and communication network 8 (emergency report);

(b) When a preselected key on the operation and display panel of any one of the copiers 1–5, FIG. 4, is operated, a usual copy mode (image formation mode) is replaced with a user request input mode for allowing the operator to input a request for repair or replenishment of supplies. Then, a user request input picture appears on the character display 83. When the operator touches a desired key on the user request input picture in order to input a request, the copier sends data representative of the request to the central control unit 6 via the data communication unit 7 and communication network 8 (emergency request).

(c) When any one of the copiers 1–5 reaches the copy inhibition number or billing number, the copier reports it to the central control unit 6 immediately via the data communication unit 7 and communication network 8 (emergency report);

(d) When any one of the copiers 1–5 reaches a preselected term or a preselected number of sheets, it reports the cumulative number of copies to the central control unit 6 via the data communication unit 7 and communication network 8 (non-emergency report); and (e) When any one of the copiers 1–5 is capable of starting its copying operation, but if a phenomenon needing some precautionary measure occurs, the copier sends information representative of such a phenomenon to the central control unit 6 via the data communication unit 7 and communication network 8 at the preselected time of the day (non-emergency report). The phenomenon needing a precautionary measure may be one in which a replaceable part has approached a designated number of times or a designated term or one in which a sensor has reached its rated level. The preselected time of the day is set by the central control unit 6 and stored in the data communication unit 7 beforehand. This communication control includes one in which when, e.g., a preselected number of times is reached before the preselected time, the copier sends information to the central control unit 6 without waiting until the preselected time.

The communication control described above is effected at the time of polling from the data communication unit 7. The word "polling" refers to sequentially designating the five copiers 1–5 in order to determine whether or not they output communication requests.

Figure 9:
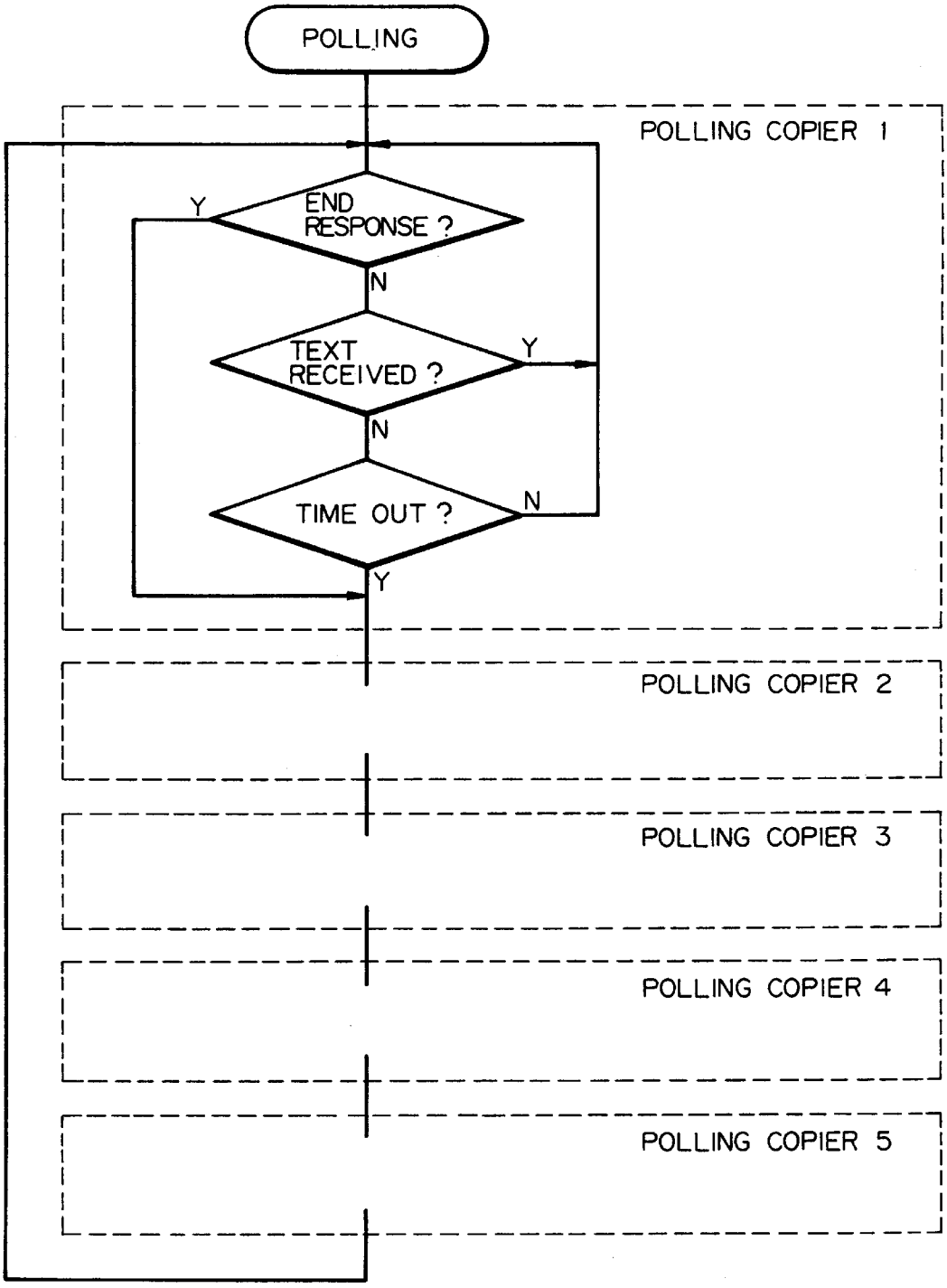
FIG. 9 is a flowchart representative of a polling procedure to be also executed by the data communication unit.

Reference will be made to FIG. 9 for describing a specific polling procedure of the data communication unit 7. The data communication unit 7 sends a particular code (or combination of particular codes) representative of the polling function and a device code designating a copier via the serial communication interface RS-485. The copiers 1–5 each compare, based on the particular code representative of the polling function, the device code following the particular code with its own device code, and knows that it is polled if they compare equal. If the copier designated has any data to send (communication request to the data communication unit 7 or the central control unit 6), it starts communicating with the data communication unit 7. If the copier designated has no data to send or ends communication under way, it outputs an end answer represented by a particular code (or combination of particular codes) and then ends communication with the data communication unit 7. In response, the data communication unit polls the next copier.

If the copier designated by the device code output from the data communication unit 7 is not capable of starting communication or outputting the end answer due to, e.g., the power-down of the copier, the data communication unit 7 ends the polling operation on the elapse of a preselected period of time. The polling procedure for the copiers 1–5 is continuously repeated until the selecting occurs.

The individual function (3) of the data communication unit 7 includes the following specific functions (a) and (b):

(a) reading total counter values; and (b) returning results of communication effected from the copiers 1–5 to the data communication unit 7 (function (2)).

Control over the reading of the total counter value of the individual copier is effected once a day at a preselected time (e.g. 0.00 a.m. or at the time of the first power-up if the copier is power-down at 0.00 a.m.) by the selecting from the data communication unit 7. The data communication unit 7 includes two memories A and B for the total counter. The unit 7 writes the total counter value read by the selecting once a day in the memory A. The memory A is therefore updated every day except when the copier is not powered-up all through the day, e.g., on a holiday. The unit 7 copies the total counter value of the memory A in the memory B once a month on a preselected date. This preselected date is set by the central control unit 6 and stored in the non-volatile RAM of the unit 7.

The content of the memory B is sent from the data communication unit 7 to the central control unit 6 by either one of the following methods (a) and (b):

(a) The central control unit 6 accesses the data communication unit 7 after the above date (for copying the content of the memory A in the memory B) in order to read the total counter value of the memory B; and (b) The data communication unit 7 automatically dials the central control unit 6 on a day after the above date and sends the total counter value of the memory B to the control unit 6 via the communication network 8. The autodialing date is also set by the control unit 6 and stored in the nonvolatile RAM of the data communication unit 7.

The data communication unit 7 is provided with a plurality of pairs of memories A and B, preparing for total counter values for black-and-white copies, application copies, color copies, etc.

Figure 10:
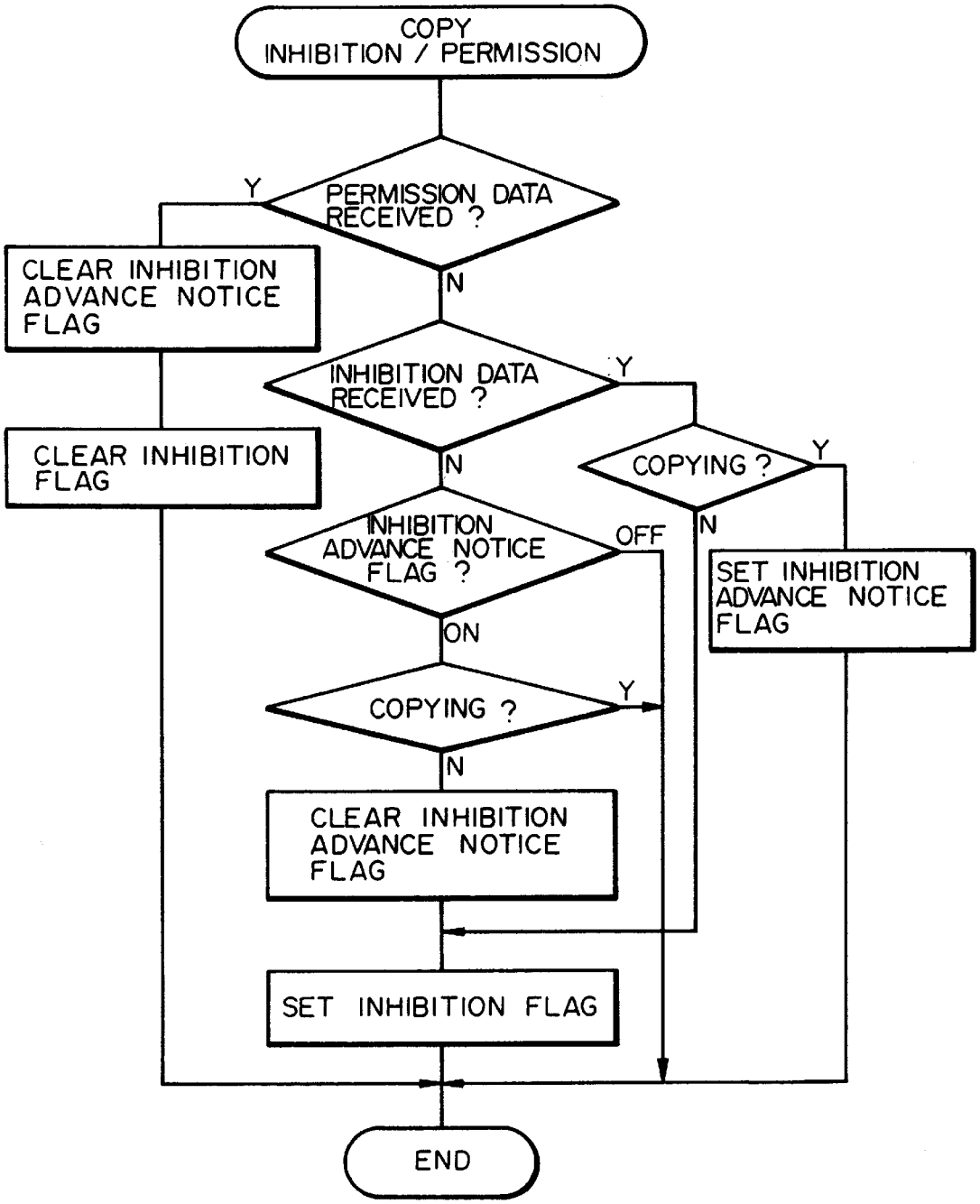
FIG. 10 is a flowchart showing a specific procedure in which each of the copiers inhibits or permits an image forming operation.

The operation of the illustrative embodiment will be described hereinafter. The control section included in each of the copiers 1–5 plays the role of image formation inhibiting means. FIG. 10 demonstrates a specific copy inhibiting/permitting procedure to be executed by the CPU 11 of each of the copiers 1–15. The CPU 11 starts the procedure of FIG. 10 every time a preselected period of time elapses.

As shown in FIG. 10, when the copier including the CPU 11 receives copy control data representative of copy inhibition from the central control unit 6 on the basis of the selecting of FIG. 8, the CPU 11 determines whether or not the copier is performing a copying operation. If the copier is not performing a copying operation, then the CPU 11 sets a copy inhibit flag in the nonvolatile RAM 15 so as to inhibit a copying operation from being newly started on the copy start key 73. If the copier is performing a copying operation, the CPU 11 sets a copy inhibition advance notice flag in the nonvolatile RAM 15. If the copying operation has ended when the CPU 11 again starts this procedure, the CPU 11 clears the copy inhibition reserve flag and sets the copy inhibit flag, thereby inhibiting a copying operation from being newly started on the copy start key 73.

Assume that the CPU 11 having set the above copy inhibit flag receives, when it again starts the same procedure, copy control data representative of copy permission from the central control unit 6 by the selecting function of the data communication unit 7. Then, the CPU 11 clears the copy inhibition reserve flag and copy inhibit flag and permits another copying operation to be effected, as desired.

As stated above, if any one of the copiers 1–5 is in operation when it receives copy control data representative of copy inhibition from the central processing unit 6, it inhibits any further copying operation only after the copying operation under way has ended. Therefore, even when the cumulative number of copies reaches the copy inhibition number or billing number during copying operation, a desired number of copies can be produced by the above copying operation. This promotes the convenient use of the copier despite the contract based on billing number.

Specific control to be executed by the central control unit 6 and data communication unit 7 when a copy inhibition number is set on any one of the copiers 1–5 will be described hereinafter. In this case, the control section included in each copier and the control section included in the central control unit 6 each constitutes particular means. When a preselected key or keys on the operation and display panel, FIG. 4, are manipulated, the CPU 11 of the copier recognizes the content of the manipulation via the serial communication control unit 17*a* and substitutes the service program mode (serviceman mode) for the usual copy mode. Specifically, the CPU 11 replaces the usual copy mode picture shown in FIG. 5 with the service program mode picture shown in FIG. 7.

When the copy inhibition number key 86 included in the service program mode picture is pressed, the CPU 11 recognizes it via the serial communication control unit 17*a* and then sets up the copy inhibition number (billing number) set mode. Subsequently, when a numerical value is input on the numeral keys 71, the CPU 11 recognizes it via the serial communication control unit 17*a* and stores or sets it in the nonvolatile RAM 15 as a copy inhibition number (e.g. 2,000 copies). Thereafter, when the copy start key 73 is pressed, the CPU 11 causes the copier to start a copying operation. At the same time, the CPU 11 restores the character display 83 to its usual copy mode picture.

While the above copying operation is under way, and every time a sense signal is input from a sheet sensor, not shown, responsive to a copy via the I/O port 16, the CPU 11 reads the cumulative number of copies out of the nonvolatile RAM 15, adds 1 (one) to the cumulative number, and again writes the resulting sum in the RAM 15. At the same time, the CPU 11 compares the sum written to the RAM 15 with a copy inhibition number stored in the RAM 15 so as to determine whether or not the cumulative number has reached the copy inhibition number. If the answer of this decision is positive, the CPU 11 enables the personal I/F 18.

In the illustrative embodiment, every time a sense signal is input from the sheet sensor, the CPU 11 reads the cumulative number of copies out of the RAM 15, adds 1 to the cumulative number, and again writes the resulting sum in the RAM 15, as stated above. Alternatively, the CPU 11 may subtract 1 from the copy inhibition number in response to every sense signal and enable the personal I/F 18 when the copy inhibition number reaches zero.

The personal I/F 18 enabled by the CPU 11 sends, when polled by the data communication unit 7 (procedure shown in FIG. 9), copy control data representative of the coincidence of the cumulative number with the copy inhibition number to the central control unit 6 via the data communication unit 7 and communication network 8. In response, the central control unit 6 sends copy control data representative of copy inhibition to the data communication unit 7 via the network 8. Then, the data communication unit 7 transfers the received copy control data to the copier by the selecting described with reference to FIG. 8.

On receiving the above copy control data from the data communication unit 7, the CPU 11 sets the copy inhibit flag or the copy inhibition reserve flag of the RAM 15. Subsequently, the CPU 11 displays a message showing the inhibition of a copying operation, e.g., "Unable to copy because the billing number is reached" or "Please renew the contrast because the billing number is reached" on the message area 85, FIG. 5, of the usual copy mode picture via the serial communication control unit 17*a*.

As stated above, when the cumulative number of copies produced by any one of the copiers 1–5 coincides with the copy inhibition number, the copier reports the coincidence to the central control unit 6. In response, the central control unit 6 returns copy control data representative of copy inhibition to the copier. As a result, the copier informs the user of the inhibition of a copying operation, promoting convenient use of the copier. In addition, the serviceman can set a copy inhibition number on the operation and display panel in the service program mode (serviceman mode) different from the usual copy mode, so that the load on the serviceman is reduced.

Hereinafter will be described a specific communication control procedure of the central control unit 6 and data communication unit 7 to occur when a copy inhibition number and a copy inhibition notice number are set in any one of the copiers 1–5. In this case, the control section of each copier and the control section of the central control unit 6 each plays the role of respective means.

Again, when the service program mode is substituted for the usual copy mode, and the copy inhibition number key 86 included in the service program mode picture is pressed, the CPU 11 of the copier recognizes it via the serial communication control unit 17*a* and then sets up the copy inhibition number set mode. When a numerical value is input on the numeral keys 71, the CPU 11 recognizes it via the serial communication control unit 17*a* and stores it in the nonvolatile RAM 15 as a copy inhibition number (e.g. 2,000 copies). Also, when the copy inhibition notice number key 87 is pressed, the CPU 11 recognizes it via the serial communication control unit 17*a* and selects a copy inhibition notice number mode. Thereafter, when a numerical value is input on the numeral keys 71, the CPU 11 recognizes it via the serial communication control unit 17*a* and writes it in the RAM 15 as a copy inhibition notice number (e.g. 2,000 copies). On the operation of the copy start key 73, the CPU 11 causes the copier to start a copying operation. At the same time, the CPU 11 restores the character display 83 to its usual copy mode picture.

The communication control of the copiers 1–5, central control unit 6 and data communication control 7 to occur after the storage of the copy inhibition number in the nonvolatile RAM 15 is identical with the previously stated control and will not be described. The following description will concentrate on communication control to occur after the copy inhibition notice number has been written to the RAM 15.

While the copying operation is under way, and every time a sense output of the sheet sensor is input via the I/O port 16, the CPU 11 reads the cumulative number of copies out of the RAM 15, adds 1 to the cumulative number, and then writes the resulting sum in the RAM 15 as a new cumulative number of copies. The CPU 11 sends copy control data representative of such a new cumulative number of copies to the central control unit 6 at a preselected interval or for a preselected number copies produced.

The CPU 11 writes a time read out of the real time clock generator 12 at a given time point in the RAM 15. Subsequently, when a time read out of the real time clock generator 12 coincides with a time a preselected period of time later than the time written to the RAM 15, the CPU 11 updates the RAM 15 with the former time as a new time and enables the personal I/F 18. Thereafter, the CPU 11 repeats such a procedure in order to send copy control data representative of the cumulative number of copies stored in the RAM 15 to the central control unit 6 at preselected intervals.

Further, in response to a request output from the central control unit 6, the copiers 1–5 each send the respective copy control data stored in the nonvolatile RAM 15 and representative of the copy inhibition number to the control unit 6. This is effected by the selecting of the data communication unit 7 described with reference to FIG. 8. When the personal I/F 18 detects the selecting, it informs the CPU 11 of the selecting. In response, the CPU 11 sends the copy inhibition number stored in the RAM 15 to the central control unit 6 via the personal I/F 18.

The central control unit 6 compares the cumulative number of copies automatically obtained from the copier and the copy inhibition number obtained from the copier as a result of the request, thereby determining whether or not the cumulative number has reached at least a number smaller than the copy inhibition number by the copy inhibition notice number(copy inhibition number—copy inhibition notice number). When the the cumulative copy number reaches at least the copy inhibition notice number, the control unit 6 returns copy control data representative of a copy inhibition advance notice to the copier. More specifically, the control unit 6 sends such copy control data to the data communication unit 7 via the network 8. In response, the data communication unit 7 transfers the copy control data to the copier by the selecting procedure of FIG. 8.

In the case where 1 is subtracted from the copy inhibition number in response to every sense output of the sheet sensor, as stated previously, the central control unit 6 receives only the copy control data representative of the copy inhibition number. In such a case, the central control unit 6 may advantageously determine whether or not the copy inhibition number has reached at least the copy inhibition notice number, and return copy control data representative of a copy inhibition advance notice to the copier when the former reaches the latter.

On receiving the copy control data representative of a copy inhibition advance notice, the copier sets the copy inhibition advance notice flag of the nonvolatile RAM 15 and displays an advance notice message, e.g., "The billing number will be reached soon." in the message area 85, FIG. 5, of the usual copy mode picture via the serial communication control unit 17*a*. If desired, a plurality of copy inhibition notice numbers, e.g., 4,000 copies, 2,000 copies and 1,000 copies may be set.

As stated above, the copiers 1–5 each send respective image formation control data representative of the cumulative number of copies produced to the central control unit 6 at preselected intervals or for every preselected number of copies produced and in response to a request from the central control unit 6. When the cumulative number coincides with a number smaller than the copy inhibition number by the copy inhibition notice number (preselected number), the central control unit 6 returns copy control data representative of a copy inhibition advance notice to the copier which sent the above cumulative number. In response, the copier displays a copy inhibition advance notice so as to alert the user to the inhibition. This allows the user to renew the contact with a distributor or a service company where the central control unit 6 is situated, and thereby further promotes convenient use of the copier. In addition, the serviceman can set a copy inhibition number and a copy inhibition notice number on the operation and display panel in the service program mode (serviceman mode) different from the usual copy mode, so that the load on the serviceman is reduced.

Another specific communication control of the central control unit 6 and data communication unit 7 to be executed when the copiers 1–5 each have the respective copy inhibition number set. In this case, the control sections of the copiers 1–5 and the control section of the central control unit 6 each plays the role of respective means which will be recited in claim 7.

Again, when the service program mode is substituted for the usual copy mode, and the copy inhibition number key 86 included in the service program mode picture is pressed, the CPU 11 of the copier recognizes it via the serial communication control unit 17*a* and then sets up the copy inhibition number set mode. Subsequently, when a numerical value is input on the numeral keys 71, the CPU 11 recognizes it via the serial communication control unit 17*a* and stores it in the nonvolatile RAM 15 as a copy inhibition number (e.g. 2,000 copies). On the operation of the copy start key 73, the CPU 11 causes the copier to start a copying operation. At the same time, the CPU 11 restores the character display 83 to its usual copy mode picture. While the copying operation is under way, and every time a sense output of the sheet sensor is input via the I/O port 16, the CPU 11 reads the cumulative number of copies out of the RAM 15, adds 1 to the cumulative number, and then writes the resulting sum in the RAM 15 as a new cumulative number of copies.

On the other hand, the central control unit 6 reads the copy inhibition number out of the RAM 15 of each copier at a preselected timing. In addition, the central control unit 6 reads the cumulative number of copies out of the RAM 15 at a predetermined interval, and compares it with the above copy inhibition number in order to determine whether or not the former has reached the latter. If the answer of this decision is positive, the central control unit 6 sends copy control data representative of copy inhibition to the data communication unit 7 via the communication network 8. In response, the data communication unit 7 transfers the received copy control data to the copier of interest by the selecting procedure of FIG. 8.

On receiving the above copy control data, the CPU 11 sets the copy inhibit flag or the copy inhibition notice flag of the RAM 15, as described with reference to FIG. 10. Subsequently, the CPU 11 displays the previously mentioned message showing the inhibition of a copying operation, e.g., "Unable to copy because the billing number number is reached." or "Please renew the contrast because the billing number is reached." on the message area 85, FIG. 5, of the usual copy mode picture via the serial communication control unit 17*a*.

As stated above, the central control unit 6 reads the copy inhibition number or billing number of each of the copiers 1–5 and reads the cumulative number of copies of each copier at preselected intervals. When the cumulative number coincides with the copy inhibition number, the central processing unit 6 returns copy control data representative of copy inhibition to the copier. In response, the copier displays copy inhibition so as to alert the user to the inhibition. This further promotes convenient use of the copier. In addition, the serviceman can set a copy stop number and a copy inhibition notice number on the operation and display panel in the service program mode (serviceman mode) different from the usual copy mode, so that the load on the serviceman is reduced.

Hereinafter will be described another specific communication control of the central control unit 6 and data communication unit 7 to occur when a copy inhibition number and a copy inhibition notice number are set in any one of the copiers 1–5. In this case, the control section of each copier and the control section of the central control unit 6 each plays the role of respective means which will be recited in claims 7 and 9.

Again, when the service program mode is substituted for the usual copy mode, and the copy inhibition number key 86 included in the service program mode picture is pressed, the CPU 11 of the copier recognizes it via the serial communication control unit 17*a* and then sets up the copy inhibition number set mode. Subsequently, when a numerical value is input on the numeral keys 71, the CPU 11 recognizes it via the serial communication control unit 17*a* and stores it in the nonvolatile RAM 15 as a copy inhibition number (e.g. 2,000 copies). Also, when the copy inhibition notice number key 87 is pressed, the CPU 11 recognizes it via the serial communication control unit 17*a* and selects a copy inhibition notice number mode. Thereafter, when a numerical value is input on the numeral keys 71, the CPU 11 recognizes it via the serial communication control unit 17*a* and writes it in the RAM 15 as a copy inhibition notice number (e.g. 2,000 copies). On the operation of the copy start key 73, the CPU 11 causes the copier to start a copying operation. At the same time, the CPU 11 restores the character display 83 to its usual copy mode picture.

The communication control of the copiers 1–5, central control unit 6 and data communication control 7 to occur after the storage of the copy inhibition number in the nonvolatile RAM 15 is identical with the previously stated control and will not be described. The following description will concentrate on communication control to occur after the copy inhibition notice number has been written to the RAM 15.

While the copying operation is under way, and every time a sense output of the sheet sensor is input via the I/O port 16, the CPU 11 reads the cumulative number of copies out of the RAM 15, adds 1 to the cumulative number, and then writes the resulting sum in the RAM 15 as a new cumulative number of copies.

On the other hand, the central control unit 6 reads each of the copy inhibition number and copy inhibition notice number out of the RAM 15 of each copier at a particular timing. In addition, the central control unit 6 reads the cumulative copy number out of the RAM 15 at a predetermined interval, and compares it with the above copy inhibition number in order to determine whether or not the former has reached at least a number smaller than the copy inhibition number by the copy inhibition notice number (copy inhibition number—copy inhibition notice number). If the cumulative number has reached at least the copy inhibition notice number, the central control unit 6 sends copy control data representative of a copy inhibition advance notice to the data communication unit 7 via the network 8. In response, the data communication unit 7 transfers the received copy control data to the copier of interest by the selecting procedure of FIG. 8.

On receiving the above copy control data, the CPU 11 sets a copy inhibition advance notice flag of the RAM 15. Subsequently, the CPU 11 displays a message showing a copy inhibition advance notice, e.g., "The billing number will be reached soon." in the message area 85, FIG. 5, of the usual copy mode picture via the serial communication control unit 17*a*.

As stated above, the central control unit 6 reads the copy inhibition number and copy inhibition notice number of each of the copiers 1–5 and reads the cumulative number of copies of each copier at preselected intervals. When the cumulative number coincides with at least a number smaller than the copy inhibition number by the copy inhibition notice number (preselected number), the central processing unit 6 returns copy control data representative of a copy inhibition advance notice to the copier. In response, the copier displays a copy inhibition advance notice so as to alert the user to the inhibition. This allows the user of the copier to renew the contract with the distributor or the service company where the central control unit 6 is situated before the copier is disabled. In addition, the serviceman can set a copy inhibition number and a copy inhibition notice number on the operation and display panel in the service program mode (serviceman mode) different from the usual copy mode, so that the load on the serviceman is reduced.

In the illustrative embodiment, when a preselected key on any one of the copiers 1–5 is pressed in order to set up the service program mode, the service program mode picture appears on the character display 83. When the copy inhibition number key 86 or the copy inhibition notice number key 87 is pressed in the service program mode picture, the CPU 11 recognizes the content of operation via the serial communication control unit 17*a* and selects the copy inhibition number set mode or the copy inhibition notice number set mode. Subsequently, when a numerical value is input on the numeral keys 71, the CPU 11 recognizes it via the serial communication control unit 17*a* and writes it in the nonvolatile RAM 15 as a copy inhibition number (billing number) or a copy inhibition notice number (preselected number). Such a procedure may be replaced with the following alternative procedure.

In the alternative procedure, the central control unit 6 sends copy control data representative of a copy inhibition number or a copy inhibition notice number to the data communication unit 7 via the network 8. The data communication unit 7 transfers the received copy control data to each of the copiers 1–5 by the selecting procedure of FIG. 9. In response, the CPU 11 of each copier writes or sets the copy inhibition number or the copy inhibition notice number represented by the copy control data in the nonvolatile RAM 15.

While the illustrative embodiment has been shown and described in relation to an image forming apparatus supervising system including copiers and a central control unit connected together via a data communication unit and a communication network, the copiers may, of course, be replaced with other image forming apparatuses, e.g., printers.

In summary, it will be seen that the present invention provides an image forming apparatus supervising system having various unprecedented advantages, as enumerated below.

(1) If an image forming apparatus is in operation when it receives copy control data representative of inhibition of image formation from a central processing unit, it inhibits its own image forming operation only after a copying operation under way has completed. Therefore, even when a cumulative number of images produced reaches a billing number during image formation, a desired number of images can be produced by the above operation. This promotes the convenient use of the copier despite a contract based on billing number.

(2) When the cumulative number of images produced by the apparatus coincides with the billing number or set number of images, the apparatus reports the coincidence to the central control unit. In response, the central control unit returns copy control data representative of inhibition to the copier. As a result, the apparatus informs the user of the inhibition of image formation, promoting convenient use of the apparatus.

(3) The apparatus sends image formation control data representative of its cumulative number of images produced to the central control unit at a preselected interval or for every preselected number of images and in response to a request from the central control unit. When the cumulative number coincides with a number smaller than the billing number by a preselected number, the central control unit returns copy control data representative of a image formation inhibition advance notice to the apparatus. In response, the apparatus displays an image formation inhibition advance notice so as to alert the user to the inhibition. This allows the user to renew the contact with the distributor or the service company where the central control unit is situated, and thereby further promotes convenient use of the apparatus.

(4) The central control unit reads the billing number of the apparatus and reads the cumulative number of copies of the apparatus at preselected intervals. When the cumulative number coincides with the billing number, the central processing unit returns copy control data representative of inhibition to the copier. In response, the apparatus displays image information inhibition so as to alert the user to the inhibition. This further promotes convenient use of the apparatus.

(5) The central control unit reads the billing number and reads the cumulative number of images of the apparatus at preselected intervals. When the cumulative number coincides with a number smaller than the billing number by a preselected number, the central processing unit returns copy control data representative of an inhibition advance notice to the apparatus. In response, the apparatus displays an image formation inhibition advance notice so as to alert the user to the inhibition. This allows the user of the copier to renew the contract with the distributor or the service company where the central control unit is situated before the apparatus is disabled.

(6) A serviceman can set the billing number number on an operation and display panel in a service program mode (serviceman mode) different from a usual copy mode, so that the load on the serviceman is reduced. If desired, the billing number may be set by the central control unit.

(7) A serviceman can set the preselected number on the operation and display panel in the service program mode different from the usual copy mode, so that the load on the serviceman is reduced. If desired, the preselected number may also be set by the central control unit.

Various modifications will become possible for those skilled in the art after receiving the teachings of the present disclosure without departing from the scope thereof.

What is claimed is:

1. An image forming apparatus supervising system comprising:

at least one image forming apparatus;

a data communication unit to which said image forming apparatus is connected;

a central control unit; and a communication line connecting said data communication unit and said central control unit, wherein said image forming apparatus selectively inhibits or permits an image forming operation of said image forming apparatus on receiving image formation control data representative of inhibition or permission, respectively, from said central control unit;

said image forming apparatus comprising inhibiting means for inhibiting, if said image forming apparatus is performing a current image forming operation at the time of receipt of the image formation control data representative of inhibition, a next image forming operation after said current image forming operation has completed.

2. A system as claimed in claim 1, wherein said image forming apparatus further comprises:

number setting means for setting a number of sheets on which images are to be formed;

accumulating means for producing a cumulative number of sheets on which images have been formed;

deciding means for determining whether or not the cumulative number of sheets has reached a set number of sheets set by said number setting means; and transmitting means for sending, when the cumulative number of sheets is coincident with the set number of sheets, image formation control data representative of a coincidence to said central control unit;

said central control unit comprising returning means for returning, on receiving the image formation control data from said image forming apparatus, image formation control data representative of image formation inhibition to said image forming apparatus;

said image forming apparatus further comprising display means for displaying image formation inhibition when said image forming apparatus receives the image formation control data representative of the image formation inhibition from said central control unit.

3. A system as claimed in claim 2, wherein said number setting means sets, when a serviceman mode of said image forming apparatus different from a usual image forming mode is selected, the set number of sheets in response to a signal output from an operation and display panel or image formation control data received from said central control unit.

4. A system as claimed in claim 1, wherein said image forming apparatus further comprises:

number setting means for setting a number of sheets on which images are to be formed;

accumulating means for producing a cumulative number of sheets on which images have been formed;

said central control unit comprising:

set number reading means for reading a set number of sheets set by said number setting means;

cumulative number reading means for reading the cumulative number of sheets output from said accumulating means at preselected intervals;

deciding means for determining whether or not the cumulative number of sheets read by said cumulative number reading means has reached the set number of sheets read by said set number reading means; and transmitting means for sending image formation control data representative of image formation inhibition to said image forming apparatus when the cumulative number of sheets has reached the set number of sheets;

said image forming apparatus further comprising display means for displaying image formation inhibition when said image forming apparatus receives the image formation control data representative of the image formation inhibition from said central control unit.

5. A system as claimed in claim 4, wherein said number setting means sets, when a serviceman mode of said image forming apparatus different from a usual image forming mode is selected, the set number of sheets in response to a signal output from an operation and display panel or image formation control data received from said central control unit.

6. An image forming apparatus supervising system comprising:

at least one image forming apparatus;

a data communication unit to which said image forming apparatus is connected;

a central control unit; and a communication line connecting said data communication unit and said central control unit, wherein said image forming apparatus selectively inhibits or permits an image forming operation of said image forming apparatus on receiving image formation control data representative of inhibition or permission, respectively, from said central control unit;

said image forming apparatus comprising inhibiting means for inhibiting, if said image forming apparatus is performing a current image forming operation at the time of receipt of the image formation control data representative of inhibition, a next image forming operation after said current image forming operation is completed;

number setting means for setting a number of sheets on which images are to be formed;

accumulating means for producing a cumulative number of sheets on which images have been formed;

first transmitting means for transmitting image formation control data representative of the cumulative number of sheets to said central control unit at a preselected interval or for every predetermined number of sheets; and second transmitting means for sending, in response to a request received from said central control unit, image formation control data representative of a set number of sheets set by said number setting means;

said central control unit comprising:

deciding means for determining, based on the image formation control data representative of the cumulative number of sheets and the set number of sheets received from said image forming apparatus, whether or not the cumulative number of sheets has reached a number smaller than a set number of sheets by a preselected number; and returning means for returning image formation control data representative of an image formation inhibition advance notice to said image forming apparatus when the cumulative number of sheets has reached the number smaller than the set number of sheets;

said image forming apparatus further comprising display means for displaying an image formation inhibition advance notice when said image forming apparatus receives the image formation control data representative of the image formation inhibition advance notice from said central control unit.

7. A system as claimed in claim 6, wherein said number setting means sets, when a serviceman mode of said image forming apparatus different from a usual image forming mode is selected, the set number of sheets in response to a signal output from an operation and display panel or image formation control data received from said central control unit.

8. An apparatus as claimed in claim 6, wherein said image forming apparatus further comprises setting means for setting, when a serviceman mode of said image forming apparatus different from a usual image forming mode is selected, the preselected number in response to a signal output from an operation and display panel or image formation control data received from said central control unit.

9. An image forming apparatus supervisory system comprising:

at least one image forming apparatus;

a data communication unit to which said image forming apparatus is connected;

a central control unit; and a communication line connecting said data communication unit and said central control unit, wherein said image forming apparatus selectively inhibits or permits an image forming operation of said image forming apparatus on receiving image formation control data representative of inhibition or permission, respectively, from said central control unit;

said image forming apparatus comprising inhibiting means for inhibiting, if said image forming apparatus is performing a current image forming operation at the time of receipt of the image formation control data representative of inhibition, a next image forming operation after said current image forming operation is completed;

number setting means for setting a number of sheets on which images are to be formed;

accumulating means for producing a cumulative number of sheets on which images have been formed;

said central control unit comprising:

set number reading means for reading a set number of sheets set by said number setting means;

cumulative number reading means for reading the cumulative number of sheets output from said accumulating means at preselected intervals;

deciding means for determining whether or not the cumulative number of sheets read by said cumulative number reading means has reached a number smaller than the set number of sheets read by said set number reading means by a preselected number; and transmitting means for sending image formation control data representative of an image formation inhibition advance notice to said image forming apparatus when the cumulative number of sheets has reached the number smaller than the set number of sheets;

said image forming apparatus further comprising display means for displaying an image formation inhibition advance notice when said image forming apparatus receives the image formation control data representative of the image formation inhibition advance notice from said central control unit.

10. A system as claimed in claim 9, wherein said number setting means sets, when a serviceman mode of said image forming apparatus different from a usual image forming mode is selected, the set number of sheets in response to a signal output from an operation and display panel or image formation control data received from said central control unit.

11. A system as claimed in claim 9, wherein said image forming apparatus further comprises setting means for setting, when a serviceman mode of said image forming apparatus different from a usual image forming mode is selected, the preselected number in response to a signal output from an operation and display panel or image formation control data received from said central control unit.

* * * * *